United States Patent [19]

Seager

[11] Patent Number: 4,850,516

[45] Date of Patent: Jul. 25, 1989

[54] POSITIVE DISPLACEMENT DISPENSER

[75] Inventor: Richard H. Seager, Mystic, Conn.

[73] Assignee: Risdon Corporation, Naugatuck, Conn.

[21] Appl. No.: 298,318

[22] Filed: Jan. 13, 1989

Related U.S. Application Data

[63] Continuation of Ser. No. 187,051, Apr. 27, 1988, abandoned, which is a continuation-in-part of Ser. No. 852,238, Apr. 15, 1986, Pat. No. 4,753,373.

[51] Int. Cl.[4] ..... B67D 5/42

[52] U.S. Cl. ..... 222/390; 222/387; 222/391

[58] Field of Search ..... 222/387, 390, 391

[56] References Cited

U.S. PATENT DOCUMENTS

| | | | |
|---|---|---|---|
| 1,716,487 | 6/1929 | Davis | 222/256 |
| 2,789,737 | 4/1957 | Palo | 222/326 |
| 3,027,052 | 3/1962 | Marraffino | 222/282 |
| 3,756,730 | 9/1973 | Spatz | 401/174 |
| 3,774,816 | 11/1973 | Bratton | 222/391 |
| 4,139,127 | 2/1979 | Gentile | 222/390 |
| 4,144,988 | 3/1979 | Bergman | 222/390 |
| 4,189,065 | 2/1980 | Herold | 222/46 |
| 4,437,584 | 3/1984 | Connors et al. | 222/137 |
| 4,437,591 | 3/1984 | von Schuckmann | 222/391 |
| 4,479,592 | 10/1984 | Rüsing et al. | 222/319 |

FOREIGN PATENT DOCUMENTS

| | | |
|---|---|---|
| 8302103 | 6/1983 | PCT Int'l Appl. . |
| 221715 | 12/1923 | United Kingdom . |
| 231874 | 4/1924 | United Kingdom . |
| 264832 | 1/1926 | United Kingdom . |
| 283644 | 10/1926 | United Kingdom . |
| 332300 | 4/1929 | United Kingdom . |
| 401003 | 5/1933 | United Kingdom . |
| 2079379 | 1/1982 | United Kingdom . |
| 2146612 | 4/1985 | United Kingdom ..... 222/390 |

*Primary Examiner*—Andres Kashnikow
*Assistant Examiner*—Patrick N. Burkhart
*Attorney, Agent, or Firm*—St. Onge Steward Johnson & Reens

[57] ABSTRACT

A positive displacement dispenser for storing and dispensing viscous materials like toothpaste is disclosed. The dispenser has a longitudinally-extending housing having an upper surface and side surfaces defining a chamber for storing viscous material, a discharge orifice in the housing through which material is dispensed, a threaded rod having an axis extending longitudinally through the chamber, and a piston mounted on the threaded rod by means of a central threaded opening. The piston is advanced along the threaded rod toward the discharge orifice to dispense material from the chamber by depressing a pivotal lever attached to the upper surface of the housing. This causes a drive bar projecting from the lever to move within a plane and turn a rotatable wheel coaxial with the threaded rod. As the pivotal lever is depressed, the drive bar, which has major dimensions in both its perpendicular coordinate directions within the plane and a minor dimension in its other perpendicular coordinate direction, moves rigidly within the plane. The dispenser is also provided with a spring return mechanism, having interlocking spring members projecting from the pivotal lever toward the upper surface of the housing and vice versa, to return the pivotal lever to its undepressed position. As this occurs, the drive bar moves along a path deviating from the plane as it bends around the rotatable wheel about its minor dimension. The dispenser is further provided with a one-way mechanism to prevent the rotatable wheel from turning in a direction which would retract the piston within the chamber.

36 Claims, 4 Drawing Sheets

FIG. 2
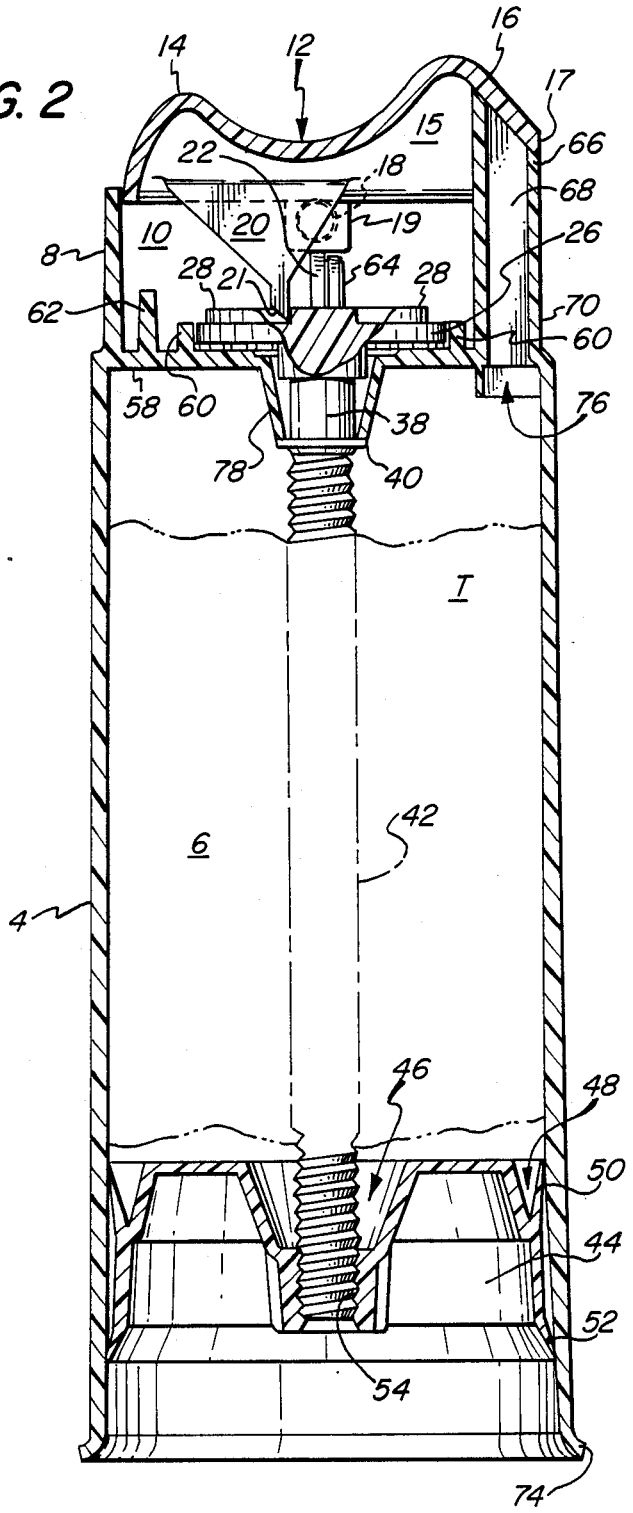
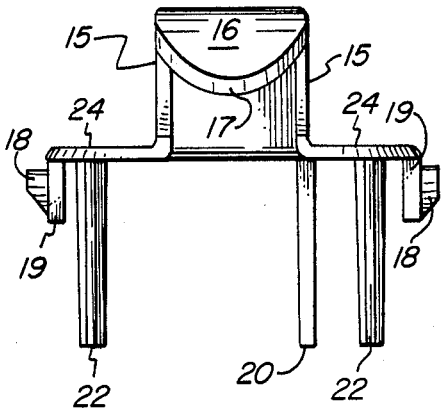
FIG. 3
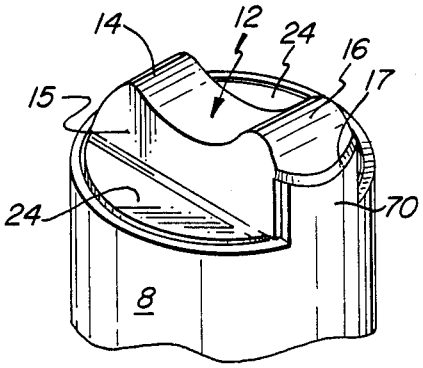
FIG. 4
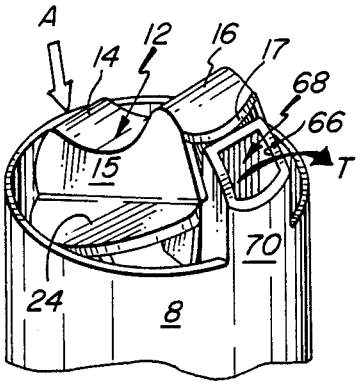
FIG. 5

POSITIVE DISPLACEMENT DISPENSER

BACKGROUND OF THE INVENTION

This is a continuation of co-pending application Ser. No. 07/187,051 filed on Apr. 27, 1988, now abandoned which is a continuation-in-part application of U.S. patent application Ser. No. 852,238, filed Apr. 15, 1986, now U.S. Pat. No. 4,753,373.

For many years, packaging engineers have sought to develop an easy to use dispenser for viscous materials like toothpaste The most common way to package such material is in flexible tubes with thin metallic walls which are squeezed to dispense toothpaste from the tube. Problems, however, arise with such dispensers when substantially all the toothpaste in the tube has been used. The consumer is then faced with either wasting the residual toothpaste by throwing out the tube or struggling to squeeze a portion of that residue onto his toothbrush.

One solution to this problem is to use a compression device to squeeze more of the residual toothpaste from conventional toothpaste tubes. As illustrated by U.S. Pat. Nos. 3,853,243 to Forman, 4,019,655 to Moeller, 4,418,840 to Gardener, 4,508,240 to Arango, and 4,515,293 to Hill et al., these compression devices utilize rollers, belts, or fluid pressure to advance toothpaste in the tube toward the tube's discharge opening. Such devices, however, tend to leave toothpaste in the tube, have complicated compression mechanisms, and occupy extra space in the bathroom.

As an alternative to toothpaste tubes, stationary toothpaste dispenser housings have been developed in which toothpaste is discharged from a chamber within the dispenser by means of fluid pressure or a pump. Examples of such toothpaste dispensers are illustrated by U.S. Pat. Nos. 3,753,516 to Crider, 3,885,707 to Wittwer, 4,303,110 to Chen, 4,424,916 to Pearson, and 4,508,239 to Rozzen. These dispensing devices, however, are somewhat complex and bulky.

Another alternative to conventional toothpaste tubes is a toothbrush attached to chambers for storing and dispensing toothpaste, as illustrated by U.S. Pat. Nos. 1,944,067 to Collins, 3,728,035 to Reitknecht, 4,145,147 to Schuck, and 4,457,641 to Smith. These devices also have problems of complexity, weight when filled with toothpaste, and bulk compared with conventional toothbrushes.

Another toothpaste dispenser is disclosed by U.S. Pat. No. 3,563,414 to Coulombe which comprises a container with a spatula attached to a rotatable cover, whereby rotation of the cover causes the toothpaste to be ejected from the container through a discharge opening.

U.S. Pat. No. 3,993,226 to Pavenick discloses a piston-type toothpaste dispenser which travels on a threaded rod to force toothpaste through an outlet. Rotation of the threaded rod is imparted by depression of a longitudinally reciprocating operating means which acts on a kinematic translating means to turn the rod. The structure of this dispenser has many component parts arranged in a complicated manner such that it is expensive to commercialize.

Other piston-type dispensers are disclosed by U.S. Pat. Nos. 1,716,487 to Davis, 2,789,737 to Palo, 3,027,052 to Marraffino, 3,756,730 to Spatz, 3,774,816 to Bratton, 4,139,127 to Gentile, 4,144,988 to Bergman, 4,189,065 to Herold, G.B. Patent No. 221,715 to Watson, G.B. Patent No. 231,874 to Julliard, G.B. Patent No. 264,832 to Billeter et al., G.B. Patent No. 283,644 to White, G.B. Patent No. 401,003 to Voelk, G.B. Patent No. 332,300 to Bramson, WO No. 83/02103 to Morel et al., and G.B. Patent No. 2,079,379 to Planas.

Another type of toothpaste dispenser which has become especially popular recently is the pump-type toothpaste dispenser.

U.S. Pat. Nos. 4,437,584 to Connors et al ("Connors"), 4,437,591 to von Shuckmann ("von Shuckman"), and 4,479,592 to Rusing et al. ("Rusing") illustrate one pump-type dispenser model in which toothpaste within a housing is dispensed by advancing a piston on an unthreaded rod within the housing toward a dispensing outlet. In the Connors and von Shuckmann dispensers, the piston is advanced by pushing the rod axially downward and then releasing pressure from the rod which returns to its original position. The piston remains stationary during downward movement of the rod by gripping the dispenser's inner wall. The piston then travels upwardly with the rod when pressure is released. In Rusing's dispenser, the piston is advanced by pushing a cylinder within the dispenser housing downwardly and then releasing pressure on the cylinder. The operation of all these devices depends on the gripping of component parts covered with toothpaste. As a result, slippage may occur which either lessens the quantity of toothpaste dispensed by each actuation or precludes the dispensing of any toothpaste at all. Operation of these dispensers is further hampered when toothpaste solidifies adjacent the gripping surfaces of the piston.

Other pump-type toothpaste dispensers are illustrated by G.B. Patent No. 432,539 to Billing, G.B. Patent No. 2,049,062 to Wippermann, G.B. Patent No. 2,064,012 to Lorscheid, and G.B. Patent No. 2,146,612 to Snedker. These dispensers are all provided with a piston which is mounted on a threaded rod and is advanced within the dispenser. The dispensers of Billing, Lorscheid, Wippermann, and Snedker all require a large number of complicated parts which would tend to make assembly of these dispensers more expensive. Snedker's dispenser is utilized by depressing a cap which causes a pair of resilient fingers to bend, turning a ratchet wheel and threaded shaft and advancing a piston on the threaded rod. With such an arrangement, it is difficult to dispense a relatively constant amount of toothpaste, because dispensing is dependent on the amount of pressure applied to the cap which has a highly variable extent of movement.

SUMMARY OF THE INVENTION

The present invention relates to a product dispenser, which is compact and easy to manufacture and use in dispensing viscous material like toothpaste.

The dispenser includes a longitudinally-extending housing with an upper surface and side surfaces defining a chamber in which material to be dispensed is stored. A threaded rod having an axis extending longitudinally through the chamber and a piston mounted on the threaded rod by means of a threaded opening through the piston are positioned within the chamber to advance material therein toward a discharge outlet. Mounted on and coaxial with the thread rod is a rotatable wheel positioned above the upper surface of the housing. The rotatable wheel is driven by a drive bar projecting from a pivotal lever mounted to an upper surface of the housing. The drive bar protects from the pivotal lever in a plane and has major dimensions in both its perpendicular coordinate directions within the plane and a minor dimension in its other perpendicular coordinate direction which is not within the plane.

To dispense toothpaste, the pivotal lever is depressed from an undepressed position to a depressed position. As a result, the pivotal lever sweeps through a path which includes the plane and moves the drive bar rigidly within that plane from a first to a second position. As a result, the rotatable member and the threaded rod turn in one direction which advances the piston within the chamber toward the discharge orifice.

To return the pivotal lever from its depressed position to its undepressed position, the dispenser is provided with a spring return mechanism having a first spring member projecting from the upper surface of the housing toward the pivotal lever and a second spring member projecting from the pivotal lever to the upper surface of the housing. The first and second spring members, which are in interlocking engagement with one another, are substantially straight when the pivotal lever is in the undepressed position and are bent when the pivotal lever is in the depressed position. When the pivotal lever is in its depressed position and pressure is released from it, the first and second spring members straighten, causing the pivotal lever to return to its undepressed position. As the pivotal lever returns to its undepressed position, the drive bar is moved from the second position to the first position along a path deviating from the plane as the drive bar bends around the outer periphery of the rotatable wheel. This bending occurs about the minor dimension of the drive bar.

The dispenser is provided with a one-way mechanism to prevent the rotatable wheel and the threaded rod from rotating in a direction which will retract the piston away from the discharge orifice. The one-way mechanism constitutes a peninsular tooth on the circumference of the wheel and a plurality of fixed ratchet dogs extending upwardly from the upper surface around the rotatable wheel. The dogs will urge the tooth radially inward upon depression of the pivotal lever and will engage the tooth after the pivotal lever is in the depressed position to prevent the wheel from rotating in a direction which will retract the piston. The one-way mechanism also serves a metering function as a result of the tooth snapping outwardly when it passes each dog, making a clicking noise.

The rotatable wheel has a plurality of curved, driven surfaces which are engaged by the drive bar as it moves from the first position to the second position. As the drive bar moves toward the second position, it engages with and rides substantially radially outwardly along one of the curved surfaces. As a result of the curving of the rotatable wheel's surface in a direction opposite its direction of rotation, the extent of rotation of the rotatable member and the threaded rod and the extent of axial movement of the piston toward the discharge orifice are all lengthened. In view of the wide sweep of the drive bar when the pivotal lever is depressed and the curvaceous nature of the driven surface, only six curved, driven surfaces are needed to turn the rotatable wheel. With only six such driven surfaces, a single depression of the pivotal lever dispenses a constant amount of toothpaste sufficient to meet consumers' brushing requirements.

The dispenser is made from four pieces of material which include the housing as one piece, the piston as another piece, the wheel and threaded rod as another piece, and the pivotal lever, drive bar, and spring return mechanism as another piece. These pieces are preferably molded from polymeric material (e.g. polyolefins like polypropylene) without sacrificing durability. The four parts are snapped together to form a compact dispenser within a single housing.

Of the four pieces, the only one which undergoes any internal stresses is the pivotal lever with respect to which the drive bar and the return spring mechanism bend. The drive bar bends only in the direction of the minor dimension when the pivotal lever returns to its undepressed position; however, such bending is slight relative to the length of the drive bar along which such bending occurs. The first and second spring members bend and straighten relative to the pivotal lever and the top of the dispenser housing as the pivotal lever moves from the undepressed to the depressed position and vice versa, respectively. Such bending does not, however, result in distortion of the spring member, because two first and second spring members are utilized, dividing the load on them in half.

The pivotal lever, drive bar, spring return means, rotatable wheel, and one-way mechanism are all isolated from toothpaste in the dispenser by the upper surface of the housing which prevents toothpaste from fouling these components. The threaded rod and piston are the only moving parts which contact the toothpaste; however, these components will not slip as a result of such contact, because they are threaded together.

BRIEF DESCRIPTION OF THE DRAWINGS

FIG. 2 is a side cross-sectional view of the present invention with the pivotal lever in its undepressed position.

FIG. 3 is a front view of the pivotal lever, showing the pivotal lever's spring members and the drive bar.

FIG. 4 is a top perspective view of the present invention, showing the pivotal lever in an undepressed position.

FIG. 5 is a perspective view of the top of the present invention, showing the pivotal lever in a depressed position.

DETAILED DESCRIPTION OF THE DRAWINGS

Figure 1:
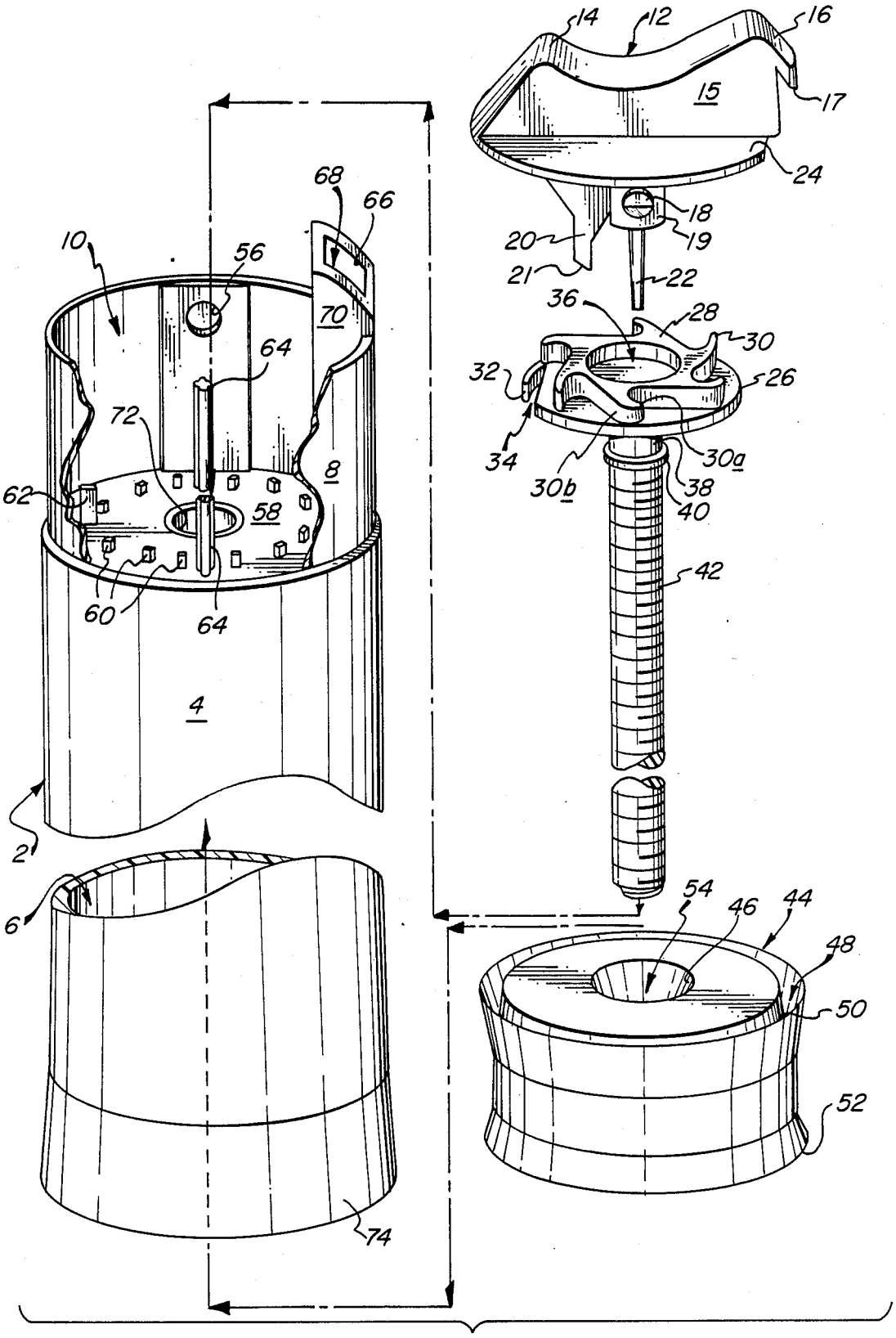
FIG. 1 is an exploded, perspective view of the present invention.

FIG. 1 is an exploded, perspective view of the positive displacement dispenser 2 according to the present invention. This dispenser includes a longitudinally-extending housing formed from a lower housing 4 and an upper housing 8. Lower housing 4 defines a toothpaste storage chamber 6, while upper housing 8 defines a drive chamber 10 separated from toothpaste storage chamber 6 by floor 58.

A pivotal lever 12 is attached to upper housing 8 by inserting pivot rods 18, which are positioned on rod mountings 19 of lever 12, into pivot rod shafts 56, as seen in FIGS. 1 and 3. Pivotal lever 12 is provided with an actuation portion 14, which the consumer presses to dispense material from the dispenser, a lever side wall 15, and a cover plate 24. Pivotal lever 12 also has a closure portion 16, having a cutting edge 17 which covers outlet 66 when material is not being dispensed and cuts material when dispensing is occurring.

Projecting downwardly from pivotal lever 12 is drive bar 20, having a pointed tip 21 to engage projections 30 of driven element 28.

Figure 6:
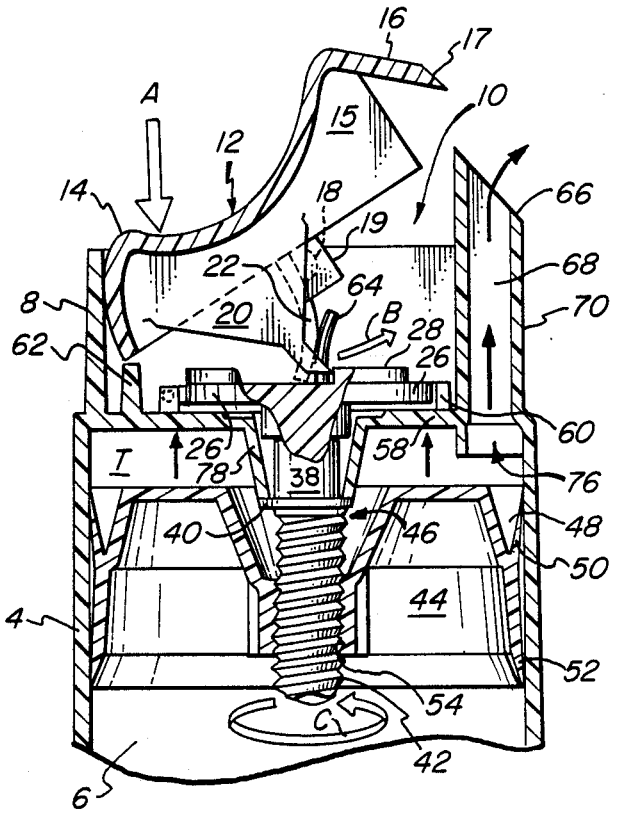
FIG. 6 is a side cross-sectional view of the present invention, showing the pivotal lever in a depressed position.

Also projecting outwardly from pivotal lever 12 are a pair of upper spring bars (only one visible in FIG. 1) which engage and interlock with a pair of lower spring bars 64 extending upwardly from floor 58, then pivotal lever 12 is in its undepressed position (see FIG. 4), upper spring bars 22 and lower spring bars 64 are both straight, as shown in FIG. 2 These bars, however, bend upon depression of pivotal lever 12, as shown in FIG. 6, so that when pressure is released from pivotal lever 12, the spring bars straighten and urge pivotal lever 12 into its undepressed position.

Attached to driven element 28 is a rotatable wheel 26 which has a coaxial threaded rod 42 extending downwardly from it. Rotatable wheel 26 is provided with a peninsular tooth 32 in its outer circumference, having a gap 34. As explained more fully infra, peninsular tooth 32 engages dogs 60 to permit the rotatable wheel 26 and the threaded rod 42 to rotate in only one direction. To save on material costs, driven element 28 may have open center portion 36. Coupling the rotatable wheel 26 and threaded rod 42 is a drive shaft 38, on which is mounted a detent ring 40.

The combined rotatable wheel 26 and threaded rod 42 is installed in housing 2 by insertion of the tip of threaded rod 42 through shaft 72 of floor 58 so that detent ring 40 and snap ring 78 (see FIG. 2) interlock, with rotatable wheel 26 being above floor 58. After threaded rod 42 and rotatable wheel 26 are installed in this manner, pivotal lever 12 can be connected to upper housing 8, as described above.

A piston 44 can then be screwed onto the tip of threaded rod 42 by passing piston 44 through the open end of lower housing 4, defined by flare base 74. The piston has a central axial screw cup 46 leading into a threaded shaft 54. The internal surfaces of lower housing 4 are wiped substantially free of toothpaste by upper wiping surface 50 and lower wiping surface 52. A wiper trough 48 is surrounded by upper wiping surface 50 so that as piston 44 advances upwardly within toothpaste storage chamber 6, piston 44 will accommodate the converging nature of the inner walls of this chamber by permitting upper wiping surface 50 to move inwardly toward wiper trough 48.

Also projecting upwardly from wall 58 is limit pedestal 62 which, as described more fully with respect to other drawings, limits the extent of depression of pivotal lever 12.

Toothpaste from within toothpaste storage chamber 6 is discharged through outlet 66, upon depression of pivotal lever 12, via tube inlet 76 (see FIG. 2) and tube 70 which defines passage 68.

FIG. 2 is a side cross-sectional view of the present invention which shows pivotal lever 12 in its undepressed position. In this position, upper and lower spring bars 22 and 64 are substantially straight, and drive bar 20 is substantially vertical. As shown in both FIGS. 2 and 4, pivotal lever 12 is substantially horizontal with closure portion 16 covering discharge orifice 66 of passage 68 defined by tube 70.

FIG. 5 discloses a perspective view of the top of the dispenser, while FIG. 6 shows a side cross-sectional view of the dispenser, both of which depict the pivotal lever in a depressed position. When depression force A is applied to actuation portion 14, pivotal lever 12 pivots with respect to upper housing 8 about pivot rod 18. As a result of pivotal lever 12 turning to a non-horizontal disposition, closure portion 16 moves away from and opens outlet 66. Toothpaste T from within toothpaste storage chamber 6 thus moves upwardly within this chamber, through tube inlet 76, passage 68 of tube 70, and outlet 66.

As best depicted in FIG. 6, the application of force A to pivotal lever 12 causes the lever to pivot until it is stopped by limit pedestal 62. During this pivotal movement of pivotal lever 12, drive bar 20 moves in direction B against the front surface **30*a* of one of the projections 30 of driven element 28 (see FIG. 7). This turns rotatable wheel 26 and threaded rod 42 in a clockwise direction C which advances piston 44 upwardly toward tube inlet 76. As a result, toothpaste is forced out of passage 68 through outlet 66**.

As is also depicted in FIG. 6, upper spring bar 22 and lower spring bar 64 bend when pivotal lever 12 is moved to its depressed position. When force A is released from actuation portion 14 of pivotal lever 12, upper and lower bars 22 and 64 straighten and return pivotal lever 12 to its undepressed position (shown in FIGS. 2 and 4) with spring-like force.

Figure 7:
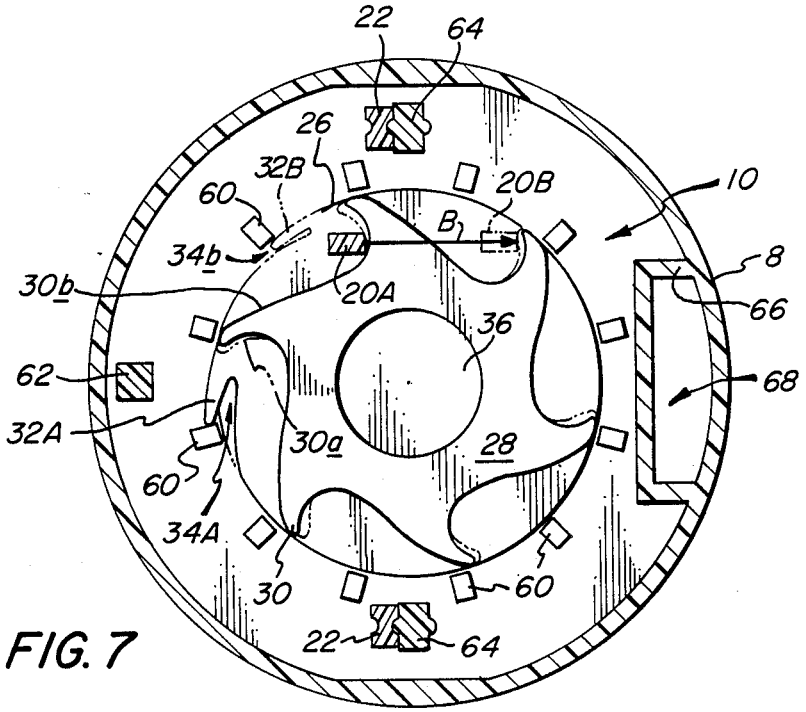
FIG. 7 is a top view of the present invention with the pivotal lever removed, showing the movement of the drive bar when the pivotal lever is moved from its undepressed to its depressed position.

FIG. 7 is a top view of the dispenser of the present invention with pivotal lever 12 removed and showing the movement of various components when pivotal lever 12 is depressed. When pivotal lever 12 is in an undepressed position, as shown in FIGS. 2 and 4, drive bar 20 is located at position 20A relative to rotatable wheel 26. When pivotal lever 12 is depressed, drive bar 20 moves rigidly along linear path B (shown in dotted lines) to position 20B. A comparison of drive bar 20 to the front surface **30*a* of the projection 30 it contacts at positions 20A and 20B shows that, as pivotal lever 12 is depressed, drive bar 20 rides outwardly along the curved front surface 30*a* of projection 30. The counterclockwise curvature of front surface 30*a* of projection 30 back toward position 20A permits drive bar 20 to engage the projection 30** for a longer period of time and, therefore, causes more material to be dispensed.

Referring again to FIG. 7, when pivotal lever 12 is in its undepressed position, peninsular tooth 32 assumes position 32A with gap 34 being fully opened, and the tip of tooth 32 is engaged by one of dogs 60. This engagement prevents counterclockwise movement of rotatable wheel 26 and threaded rod 42. As a result, piston 44 will move only in an upward direction toward discharge orifice 66. When pivotal lever 12 is depressed and drive bar 20 is moved from position 20A to 20B, rotatable wheel 26 will move in a clockwise direction. As this occurs, peninsular tooth 32 will move inwardly to position 32B, diminishing the size of gap 34, to permit the tooth to pass around each dog 60. The movement of drive bar 20 from position 20A to 20B causes peninsular tooth 32 to pass to dogs 60.

Figure 8:
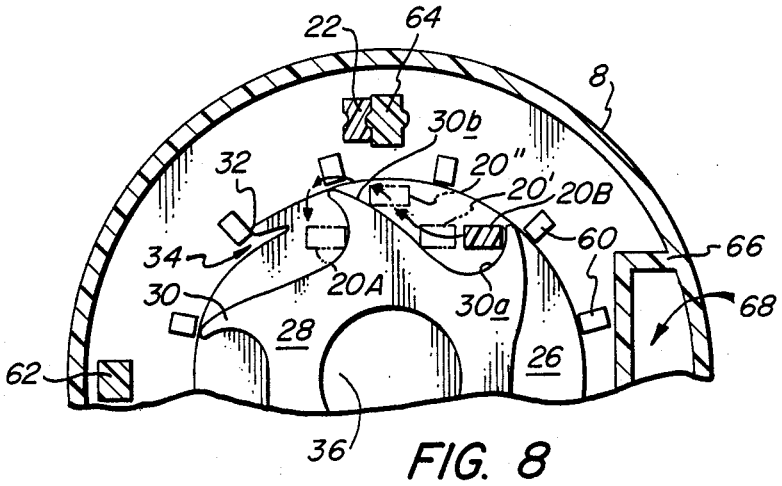
FIG. 8 is a top view with the pivotal lever removed, showing the movement of the drive bar as the pivotal lever returns from its depressed position to its undepressed position.

FIG. 8 is a top view of the present invention with pivotal lever 12 removed, showing the operation of component when pivotal lever 12 is moved from its depressed position to its undepressed position. When pivotal lever 12 has reached its depressed position and drive bar 20 has reached position 20B, pivotal lever 12 can be released, causing upper spring bars 22 and lower spring bars 64 to propel the lever to its undepressed position and drive bar 20 to position 20A. As shown in FIG. 8, drive bar 20 rides along the curved back surface **30*b* of the ccunterclockwisely adjacent projection 30. As this occurs, drive bar 20 moves radially outwardly to position 20' and then to position 20'' at the tip of this projection 30. Drive bar 20 will then recoil inwardly to position 20A where it can engage with front surface 30*a* of that projection 30. The positions of drive bar 20 relative to pivotal lever 12, as pivotal lever 12 is moved from its undepressed position to its depressed position and vice versa are also shown in FIG. 9**.

Figure 9:
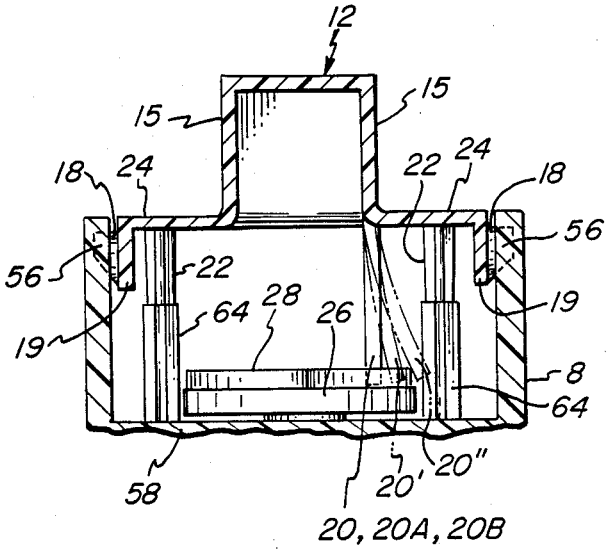
FIG. 9 is a side cross-sectional view of the top of the present invention, showing the interlocking engagement of the spring members of the pivotal lever and the housing and the bending motion of the drive bar.

FIG. 9, which is a side cross-sectional view of pivotal lever 12 in engagement with upper housing 8, also shows the positioning of pivot rod 18 within pivot rod shaft 56 of upper housing 8 and the interlocking engagement of upper spring bars 22 and lower spring bars 64.

In operation, dispenser 2 is normally in the position shown in FIG. 2 with pivotal lever 12 being substantially horizontal, closure portion 16 covering outlet 66, drive bar 20 substantially vertical, and upper and lower spring bars 22 and 64 straight. When force A is applied downwardly against actuation portion 14 of pivotal lever 12, pivotal lever 12 rotates about pivot rod 18, causing the tip 21 of drive bar 20 to push front surface **30*a* of one of projections 30 of driven element 28 in a clockwise direction. This causes rotatable wheel 26 and threaded rod 42 also to rotate in a clockwise direction and advance piston 44 toward outlet 66. As a result of this advancement of piston 44, toothpaste is forced upwardly through toothpaste storage chamber 6, tube inlet 76, passage 68 of tube 70, and outlet 66 which is now uncovered by closure portion 16**.

As drive bar 20 pushes against driven element 28, its tip 21 moves rigidly (i.e. without bending) from position 20A to position 20B along a planar path. As this occurs, the bottom portion of drive bar 20 in engagement with driven element 28, rises so that tip 21 is substantially horizontal.

When pivotal lever 12 is depressed to its fullest extent, causing it to contact limit pedestal 62, upper and lower spring bars 22 and 64 are bent, as shown in FIG. 6. When downward force A is released from actuation portion 14 of pivotal lever 12, upper and lower spring bars 22 and 64 will straighten and return pivotal lever 12 to its undepressed position, as shown in FIG. 2. When this occurs, drive bar 20 will also be returned to its orientation shown in FIG. 2 by virtue of its attachment to pivotal lever 12. This movement of drive bar 20 is not, however, along the previously-discussed planar path. Instead, drive bar 20 rides radially outwardly along the back surface **30*b* of the counterclockwisely adjacent projection 30 in a radially outward direction from position 20B to positions 20', 20'', and finally 20A**.

Despite the exertion of a counterclockwise force by drive bar 20 against the counterclockwisely adjacent projection 30, driven portion 28, rotatable wheel 26, and threaded rod 42 do not turn in a counterclockwise direction, because the tip of peninsular tooth 32 abuts against a dog 60 to prevent such counterclockwise movement. As a result of the nonrotation of threaded rod 42, piston 44 remains stationary, while pivotal lever 12 returns to its undepressed position.

Drive bar thus firmly and rigidly engages driven element 28 during depression of pivotal lever 12 but bends about its thinnest dimension around driven element 28 when pivotal lever 12 is returned to its undepressed position. This bending in only one direction extends the lifespan of drive bar 20 while exerting a constant amount of force to dispense a fixed amount of material. The use of a pair of upper and lower spring bars also reduces fatigue, because the force necessary to return pivotal lever 12 to its undepressed position is distributed between a pair of two spring elements.

Although the invention has been described for the purpose of illustration, it is understood that such detail is solely for that purpose and variations can be made therein by those skilled in the art without departing from the spirit and scope of the invention.

What is claimed:

1. A dispenser comprising:

a longitudinally-extending housing having an upper surface and side surfaces defining a chamber in which material to be dispensed is stored;

a discharge orifice in said housing through which material in the chamber is dispensed;

a threaded rod having an axis extending longitudinally through the chamber;

a piston mounted on said threaded rod by means of a threaded opening through the piston;

a rotatable member attached to said threaded rod;

a pivotal lever attached to the upper surface of said longitudinally-extending housing movable between a depressed position and an undepressed position;

a drive bar projecting from said pivotal lever toward said rotatable member within a plane, said drive bar having major dimensions in both its perpendicular coordinate directions within the plane and a minor dimension in its other perpendicular coordinate direction which is not within the plane, whereby depression of said pivotal lever from the depressed position to the undepressed position causes said pivotal lever to sweep through a path which includes the plane and moves said drive bar rigidly within the plane, turning said rotatable member and said threaded rod in one direction to advance said piston within said chamber toward said discharge orifice.

2. A dispenser according to claim 1 further comprising:

return means engaging said housing and said pivotal lever to return said drive bar from the second position to the first position and to move said pivotal lever from the depressed position to the undepressed position upon release of pressure from said pivotal lever.

3. A dispenser according to claim 2, wherein said return spring means comprises:

a first spring member projecting from the upper surface of said housing toward said pivotal lever and a second spring member projecting from said pivotal lever toward the upper surface of said housing and in engagement with the first spring member, wherein the first and second spring members are substantially straight when said pivotal lever is in the undepressed position and bent when said pivotal lever is in the depressed position, whereby release of pressure from said pivotal lever, when in the depressed position, causes the first and second spring members to straighten and return said pivotal lever to the undepressed position.

4. A dispenser according to claim 2, wherein, when pressure is released from said pivotal lever, said drive bar moves from the second position to the first position along a path deviating from the plane as said drive bar bends around said rotatable member about the minor dimension.

5. A dispenser according to claim 3 wherein said pivotal lever, said drive bar, and said second member are integrally formed from polymeric material.

6. A dispenser according to claim 1, wherein said rotatable member is a rotatable wheel.

7. A dispenser according to claim 6, wherein the rotatable wheel has a plurality of driven surfaces which are engaged by said drive bar as is moves in the plane from the first position to the second position, causing the rotatable wheel and said threaded rod to turn in one direction to advance said piston toward said discharge orifice.

8. A dispenser according to claim 7, wherein the plurality of driven surfaces are curved such that, when each of the driven surfaces is engaged by said drive bar, the surface extends substantially radially outward from the longitudinal axis extending through said threaded rod and is curved in a direction generally toward the first position, whereby, as said drive bar moves in the first direction, it engages with and rides substantially radially outward along the curved surface, lengthening both the extent of rotation of said rotatable member and said threaded rod and the extent of movement of said piston toward said orifice.

9. A dispenser according to claim 7, wherein said drive bar has a pointed tip which engages each of the driven surfaces of the rotatable wheel, the pointed tip being closer to the rotatable wheel than any other portion of said drive bar.

10. A dispenser according to claim 6 further comprising:

one-way means to prevent the rotatable wheel and said threaded rod from rotating in a direction which will retract said piston away from said discharge orifice.

11. A dispenser according to claim 10, wherein the one-way means comprises:

a peninsular tooth connected to the rotatable wheel along its circumference but spaced from radially inward portions of the rotatable wheel by a cutout extending inwardly from the circumference of the rotatable wheel and a plurality of fixed ratchet dogs surrounding the rotatable wheel, whereby at least one of the dogs will urge the tooth radially inwardly toward the cutout upon depression of said pivotal lever and will engage the tooth after said pivotal lever is in the depressed position to prevent rotation of the rotatable wheel and said threaded rod in a direction which will retract said piston.

12. A dispenser according to claim 1 further comprising:

a standing vane attached to the upper surface of said housing to restrict movement of said pivotal lever as it pivots upon depression.

13. A dispenser according to claim 1 further comprising:

closure means to cover said discharge orifice when material is not being dispensed from said housing.

14. A dispenser according to claim 13, wherein said closure means is integral with said pivotal lever and has a cutter to slice material being dispensed from said discharge orifice.

15. A dispenser according to claim 1, further comprising:

a discharge tube defining a passage connecting the chamber of said housing and said discharge orifice.

16. A dispenser according to claim 1, wherein the upper surface of said housing has a snap ring extending into the chamber and said threaded rod has a detent ring engageable with the snap ring to prevent axial movement of said threaded rod and to seal the chamber.

17. A dispenser according to claim 1, wherein said piston comprises:

a first wiping surface extending from said piston toward said discharge orifice to wipe material being dispensed from the side surfaces of said housing defining the chamber and a second wiping surface further from said discharge orifice than the first wiping surface.

18. A dispenser according to claim 17, wherein the side surfaces of said housing defining the chamber converge toward said discharge orifice and wherein said piston has a trough adjacent the first wiping surface to permit radially-inward movement of the first wiping surface as said piston moves toward said discharge orifice.

19. A dispenser according to claim 1, wherein said dispenser is made from four molded polymeric pieces, wherein said housing is one piece, said piston is another piece, said wheel and said threaded rod are another piece, and said actuating lever and said drive bar are another piece.

20. A dispenser comprising:

a longitudinally-extending housing having surfaces defining a chamber in which material to be dispensed is stored;

a discharge orifice in said housing through which material in the chamber is dispensed;

a threaded rod having an axis extending longitudinally through the chamber;

a piston mounted on said threaded rod by means of a threaded opening through the piston;

a rotatable member attached to said threaded rod;

actuation means mounted to said longitudinally extending housing; and a drive bar projecting from said actuation means toward said rotatable member within a plane, said drive bar having major dimensions in both its perpendicular coordinate directions within the plane and a minor dimension in its other perpendicular coordinate direction which is not within the plane, whereby, when force is applied to said actuation means in a first direction, said drive bar moves rigidly within the plane from a first position to a second position, causing said rotatable member and said threaded rod to rotate in one direction to advance said piston within the chamber toward said discharge orifice, and, when force is applied to said actuation means in a second direction opposite the first direction, said drive bar moves from the second position to the first position along a path deviating from the plane as said drive bar bends around said rotatable member about the minor dimension.

21. A dispenser according to claim 20 further comprising:

return spring means engaging said housing and said actuation means to effect return of said drive bar from the second position to the first position and movement of said actuation means in the second direction.

22. A dispenser according to claim 21, wherein said return spring means comprises:

a first spring member projecting from an upper surface of said housing toward said actuation means and a second spring member projecting from said actuation means toward the upper surface of said housing and in engagement with the first spring member, wherein the first and second spring members are substantially straight when said actuation means is in the first position and bent when said actuation means is in the second position, whereby straightening of the first and second spring members moves said actuation means from the second position to the first position.

23. A dispenser according to claim 20, wherein said rotatable member is a rotatable wheel having a plurality of driven surfaces which are engaged by said drive bar as it moves in the plane from the first position to the second position, causing the rotatable wheel and said threaded rod to turn in one direction to advance said piston toward said discharge orifice.

24. A dispenser according to claim 23, wherein the plurality of driven surfaces are curved such that, when each of the driven surfaces is engaged by said drive bar, the surface extends substantially radially outward from the longitudinal axis extending through said threaded rod and is curved in a direction generally toward the first position, whereby, as said drive bar moves in the first direction, it engages with and rides substantially radially outward along the curved surface, lengthening both the extent of rotation of said rotatable member and said threaded rod and the extent of movement of said piston toward said orifice.

25. A dispenser according to claim 24, wherein each of the curved driven surfaces is formed by a projection extending substantially radially outward from the longitudinal axis extending through said threaded rod and curved in a direction generally toward the first position, wherein each projection has a similarly curved back surface on which said drive bar bends in moving from the second position to the first position.

26. A dispenser according to claim 23, wherein said rotatable member is a rotatable wheel and further comprising:

one-way means to prevent the rotatable wheel and said threaded rod from rotating in a direction which will retract said piston away from said discharge orifice.

27. A dispenser according to claim 26, wherein the one-way means comprises:

a peninsular tooth connected to the rotatable wheel along its circumference but spaced from radially inward portions of the rotatable wheel by a cutout extending inwardly from the circumference of the rotatable wheel and a plurality of fixed ratchet dogs surrounding the rotatable wheel, whereby at least one of the dogs will urge the tooth radially inwardly toward the cutout upon depression of said pivotal lever and will engage the tooth said pivotal lever is in the depressed position to prevent rotation of the rotatable wheel and said threaded rod in a direction which will retract said piston.

28. A dispenser comprising:

a longitudinally-extending housing having an upper surface and side surfaces defining a chamber in which material to be dispensed is stored;

a discharge orifice in said housing through which material in the chamber is dispensed;

a threaded rod having an axis extending longitudinal through the chamber;

a piston mounted on said threaded rod by means of a threaded opening through the piston;

a rotatable member attached to said threaded rod;

a pivotal lever attached to the upper surface of said longitudinally-extending housing movable between a depressed position and an undepressed position;

a drive bar projecting from said pivotal lever toward said rotatable member, whereby depression of said pivotal lever from the undepressed position to the depressed position moves said drive bar in a first direction against said rotatable member, causing said rotatable member and said threaded rod to rotate in one direction to advance said piston within the chamber toward said discharge orifice; and return spring means comprising a first spring member projecting from the upper surface of said housing toward said pivotal lever and a second spring member projecting from the pivotal lever toward the upper surface of said housing and in engagement with the first spring member, wherein the first and second spring members are substantially straight when said pivotal lever is in the undepressed position and bent when said pivotal lever is in the depressed position, whereby release of pressure from said pivotal lever causes the first and second spring members to straighten and return said pivotal lever to the undepressed position.

29. A dispenser according to claim 28, wherein said pivotal lever, said drive bar, and said second member are integrally formed from polymeric material.

30. A dispenser according to claim 28, wherein said rotatable member is a rotatable wheel.

31. A dispenser according to claim 30 further comprising:

one-way means to prevent the rotatable wheel and said threaded rod from rotating in a direction which will retract said piston away from said discharge orifice.

32. A dispenser according to claim 30, wherein the one-way means comprises:

a peninsular tooth connected to the rotatable wheel along its circumference but spaced from radially inward portions of the rotatable wheel by a cutout extending inwardly from the circumference of the rotatable wheel and a plurality of fixed ratchet dogs surrounding the rotatable wheel, whereby at least one of the dogs will urge the tooth radially inwardly toward the cutout upon depression of said pivotal lever and will engage the tooth after said pivotal lever is in the depressed position to prevent rotation of the rotatable wheel and said threaded rod in a direction which will retract said piston.

33. A dispenser according to claim 28, wherein the first and second spring members have interlocking surfaces in engagement with one another.

34. A dispenser comprising:

a longitudinally-extending housing having surfaces defining chamber in which material to be dispensed is stored;

discharge orifice in said housing through which material in the chamber is dispensed;

a threaded rod having an axis extending longitudinally through the chamber;

a piston mounted on said threaded rod by means of a threaded opening through the piston;

a rotatable member attached to said threaded rod and having a plurality of projections, each with a curved driven surface;

a drive bar projecting toward said rotatable member and movable in a first direction to engage one of the plurality of curved driven surfaces, which turns said rotatable member and said threaded rod in one direction, and which advances said piston within the chamber toward said discharge orifice, wherein, when each of the driven surfaces is engaged by said drive bar, that surface extends substantially radially outward from the axis extending through said threaded rod and is curved in a direction generally opposite to the first direction, whereby, as said drive bar moves in the first direction, it engages with and rides substantially radially outward along the curved surface, lengthening both the extent of rotation of said rotatable member and said threaded rod and the extent of movement of said piston toward said orifice.

35. A dispenser according to claim 34, wherein said rotatable member has six curved driven surfaces.

36. A dispenser comprising:

a longitudinally-extending housing having an upper surface and side surfaces defining a chamber in which material to be dispensed is stored;

a discharge orifice in said housing through which material in the chamber is dispensed;

a discharge tube defining a passage connecting the chamber of said housing and said discharge orifice;

a threaded rod having an axis extending longitudinally through the chamber;

a piston mounted on said threaded rod by means of a threaded opening through the piston;

a rotatable wheel attached to said threaded rod and having a plurality of projections, each with a curved driven surface and a curved back surface;

a pivotal lever attached to the upper surface of said longitudinally-extending housing movable between a depressed position and an undepressed position;

closure means integral with said pivotal lever to cover said discharge orifice when material is not being dispensed from said housing and having a cutter to slice material dispensed through said discharge orifice;

one-way means to prevent the rotatable wheel and said threaded rod from rotating in a direction which will retract said piston away from said discharge orifice comprising:

a peninsular tooth connected to the rotatable wheel along its circumference but spaced from radially inward portions of the rotatable wheel by a cutout extending inwardly from the circumference of the rotatable wheel and a plurality of fixed ratchet dogs surrounding the rotatable wheel, whereby at least one of the dogs will urge the tooth radially inwardly toward the cutout upon depression of said pivotal lever and will engage the tooth after said pivotal lever is in the depressed position to prevent rotation of the rotatable wheel and said threaded rod in a direction which will retract said piston;

a drive bar projecting from said pivotal lever toward said rotatable member within a plane, said drive bar having major dimensions in both its perpendicular coordinate directions within the plane and a minor dimension in its other perpendicular coordinate direction which is not within the plane, whereby depression of said pivotal lever from the depressed position to the undepressed position causes said pivotal lever to sweep through a path which includes the plane and moves said drive bar rigidly within the plane from a first position to a second position, engaging one of the plurality of driven surfaces, and turning said rotatable member and said threaded rod in one direction to advance said piston within said chamber toward said discharge orifice, wherein, when pressure is released from said pivotal lever, said drive bar moves from the second position to the first position along a path deviating from the plane as said drive bar bends around said rotatable member, along the counterclockwisely adjacent curved back surface, about the minor dimension, wherein, when each of the driven and back surfaces are engaged by said drive bar, these surfaces extend substantially radially outward from the axis extending through said threaded rod and are curved in a direction generally toward the first position, whereby, as said drive bar moves in the first direction, it engages with and rides substantially radially outward along the curved surface, lengthening both the extent of rotation of said rotatable member and said threaded rod and the extent of movement of said piston toward said orifice, and wherein said drive bar has a pointed tip which engages each of the driven surfaces of the rotatable wheel, the pointed tip being closer to the rotatable wheel than any other portion of said drive bar; and return spring means engaging said housing and said pivotal lever to return said drive bar from the second position to the first position and to move said pivotal lever from the depressed position to the undepressed position upon release of pressure from said pivotal lever comprising:

a spring member projecting from the upper surface of said housing and toward said pivotal lever and pivotal lever toward the upper surface of said housing and in engagement with the first spring member, wherein the first and second spring members are substantially straight when said pivotal lever is in the undepressed position and bent when said pivotal lever is in the depressed position, whereby release of pressure from said pivotal lever causes the first and second spring members to straighten and return said pivotal lever to the undepressed position.

* * * * *